US011414306B2

(12) United States Patent
Waisanen et al.

(10) Patent No.: US 11,414,306 B2
(45) Date of Patent: Aug. 16, 2022

(54) TROLLEY INSTALLER

(75) Inventors: Steven K. Waisanen, Big Bend, WI (US); Steven M. Lawrence, Waukesha, WI (US)

(73) Assignee: MHE Technologies, Inc., Wilmington, DE (US)

( * ) Notice: Subject to any disclaimer, the term of this patent is extended or adjusted under 35 U.S.C. 154(b) by 1541 days.

(21) Appl. No.: 12/093,237

(22) PCT Filed: Nov. 16, 2006

(86) PCT No.: PCT/US2006/044446

§ 371 (c)(1),
(2), (4) Date: Nov. 29, 2017

(87) PCT Pub. No.: WO2007/059260

PCT Pub. Date: May 24, 2007

(65) Prior Publication Data

US 2021/0323795 A1 Oct. 21, 2021

Related U.S. Application Data

(60) Provisional application No. 60/737,089, filed on Nov. 16, 2005.

(51) Int. Cl.
*B66C 19/00* (2006.01)
*B66C 11/00* (2006.01)
(Continued)

(52) U.S. Cl.
CPC ..... *B66C 19/00* (2013.01); *B66C 1/10* (2013.01); *B66C 11/00* (2013.01); *B66C 13/08* (2013.01)

(58) Field of Classification Search
CPC ..... B66C 13/08; B66C 1/10; B66C 19/00; B66C 11/00
See application file for complete search history.

(56) References Cited

U.S. PATENT DOCUMENTS 2,675,131 A 4/1954 Osojnak
3,783,792 A 1/1974 Cullom
(Continued)

FOREIGN PATENT DOCUMENTS

DE 1556357 A1 * 3/1970 ..... B66C 13/08
DE 4332232 C1 * 2/1995 ..... B66C 17/20

OTHER PUBLICATIONS

International Preliminary Report on Patentability, International Application No. PCT/S2006/044446, dated Nov. 16, 2007.
(Continued)

*Primary Examiner* — Sang K Kim
*Assistant Examiner* — Nathaniel L Adams
(74) *Attorney, Agent, or Firm* — Porter, Wright, Morris & Arthur, LLP

(57) ABSTRACT

A trolley installer for use with a crane bridge is configured for supporting a trolley thereon. The trolley installer includes a lift system adapted for mounting to the crane bridge. The lift system includes a lift mechanism and a strand coupled to the lift mechanism. The trolley installer also includes a platform member including a table for supporting a trolley and an attachment mechanism for releasably coupling with the strand of the lift system. The lift mechanism is operable to lift and lower the platform member relative to the crane bridge.

28 Claims, 20 Drawing Sheets

(51) Int. Cl.
*B66C 1/10* (2006.01)
*B66C 13/08* (2006.01)

(56) References Cited

U.S. PATENT DOCUMENTS

| | | | | | |
|---|---|---|---|---|---|
| 3,887,080 | A | * | 6/1975 | Wilson | B66C 11/08 212/318 |
| 3,973,679 | A | | 8/1976 | Hass et al. | |
| 4,053,059 | A | | 10/1977 | Hass et al. | |
| 4,064,615 | A | | 12/1977 | Andersson | |
| 4,350,254 | A | * | 9/1982 | Noly | B66C 13/08 212/242 |
| 4,502,527 | A | * | 3/1985 | Brewer | B66C 17/00 164/412 |
| 4,524,873 | A | | 6/1985 | McGowan | |
| 4,875,415 | A | | 12/1989 | Kasugai | |
| 5,765,703 | A | * | 6/1998 | Shiwaku | B66C 13/08 212/274 |

OTHER PUBLICATIONS

Office Action for Canadian Patent Application No. 2,630,065, dated Mar. 28, 2013.

* cited by examiner

TROLLEY INSTALLER

CROSS-REFERENCE TO RELATED APPLICATION

This application claims priority from U.S. Provisional Patent Application No. 60/737,089, entitled "Trolley Installer", filed Nov. 16, 2005 by Steven K. Waisanen and Steven M. Lawrence.

BACKGROUND

The present invention relates to an overhead crane including a trolley, and more particularly to a trolley installer for installing and removing the trolley.

Conventional overhead cranes used within a facility include a bridge with a pair of bridge girders that move along a pair of main support beams. A pair of rails is supported by the girders and a trolley moves along the pair of rails in a direction transverse to the main support beams. In case of failure of the trolley or a new trolley is desired, the removal of an existing trolley and installation of a new trolley, which may be at least 100 tons, is required as part of a project scope. Typically, there is no access to the trolley from outside of the facility via a mobile crane and a mobile crane cannot be lifted to an operating deck, for example, three floors up inside the facility. Also, a mobile crane cannot effectively access the overhead crane as the hatchway is narrow (e.g., 18 feet by 18 feet) and is located about 100 feet from the floor where the mobile crane would be located.

SUMMARY

In one embodiment, the invention provides a trolley installer for use with a crane bridge configured for supporting a trolley thereon. The trolley installer includes a lift system adapted for mounting to the crane bridge. The lift system includes a lift mechanism and a strand coupled to the lift mechanism. The trolley installer also includes a platform member including a table for supporting a trolley and an attachment mechanism for releasably coupling with the strand of the lift system. Wherein, the lift mechanism is operable to lift and lower the platform member relative to the crane bridge.

In another embodiment, the invention provides a trolley installer for use with a crane bridge having a pair of spaced apart girders configured for supporting a trolley thereon. The trolley installer includes a lift system adapted for mounting to the crane bridge. The lift system includes a lift mechanism and a strand coupled to the lift mechanism. The trolley installer also includes a platform member having a turntable for supporting a trolley and an attachment mechanism for releasably coupling the strand of the lift system. The turntable is operable to rotate relative to the platform member between a first position, in which the trolley spans across the girders, and a second position, in which the trolley fits between the girders. Wherein, the lift mechanism lifts and lowers the platform member relative to the crane bridge.

In another embodiment, the invention provides a trolley installer for use with a crane bridge having a pair of spaced apart girders configured for supporting a trolley thereon. The trolley installer includes a lift system adapted for mounting to the crane bridge. The lift system includes a lift mechanism and a strand coupled to the lift mechanism. The trolley installer also includes a platform member having a tilt table for supporting a trolley and an attachment mechanism for releasably coupling the strand of the lift system. The tilt table is operable to pivot relative to the platform member between a first position, in which the trolley spans across the girders, and a second position, in which the trolley fits between the girders. Wherein, the lift mechanism lifts and lowers the platform member relative to the crane bridge.

In another embodiment, the invention provides a trolley installer for use with a crane bridge configured for supporting a trolley thereon. The trolley installer includes a pair of lift systems. Each lift system includes a pair of end trucks adapted for mounting and traveling on the crane bridge, a cross member extending between the end trucks, and lift mechanisms supported by the cross member. Each lift mechanism includes a strand. The trolley installer also includes attachment mechanisms releasably coupled to each strand of the lift systems, and a platform member. The platform member includes a table for supporting and securing the trolley, and coupling areas. Each coupling area receives at least one attachment mechanism. The trolley installer further includes a control unit having a motor to drive the lift mechanisms. The lift mechanisms lift and lower the platform member relative to the crane bridge.

In another embodiment, the invention provides a method for installing a trolley on a crane bridge. The method includes coupling the trolley to a lower member, positioning the trolley to fit between a first girder and a second girder of the crane bridge, and lifting the lower member and the trolley toward the crane bridge. The method also includes positioning the trolley to extend between the first girder and the second girder of the crane bridge, lowering the lower member such that the trolley engages the crane bridge, and uncoupling the trolley from the lower member.

In another embodiment, the invention provides a method for removing a trolley from a crane bridge. The method includes raising a lower member to engage the trolley, coupling the trolley to the lower member, and lifting the trolley apart from the crane bridge. The method also includes positioning the trolley to fit between a first girder and a second girder of the crane bridge and lowering the lower member.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
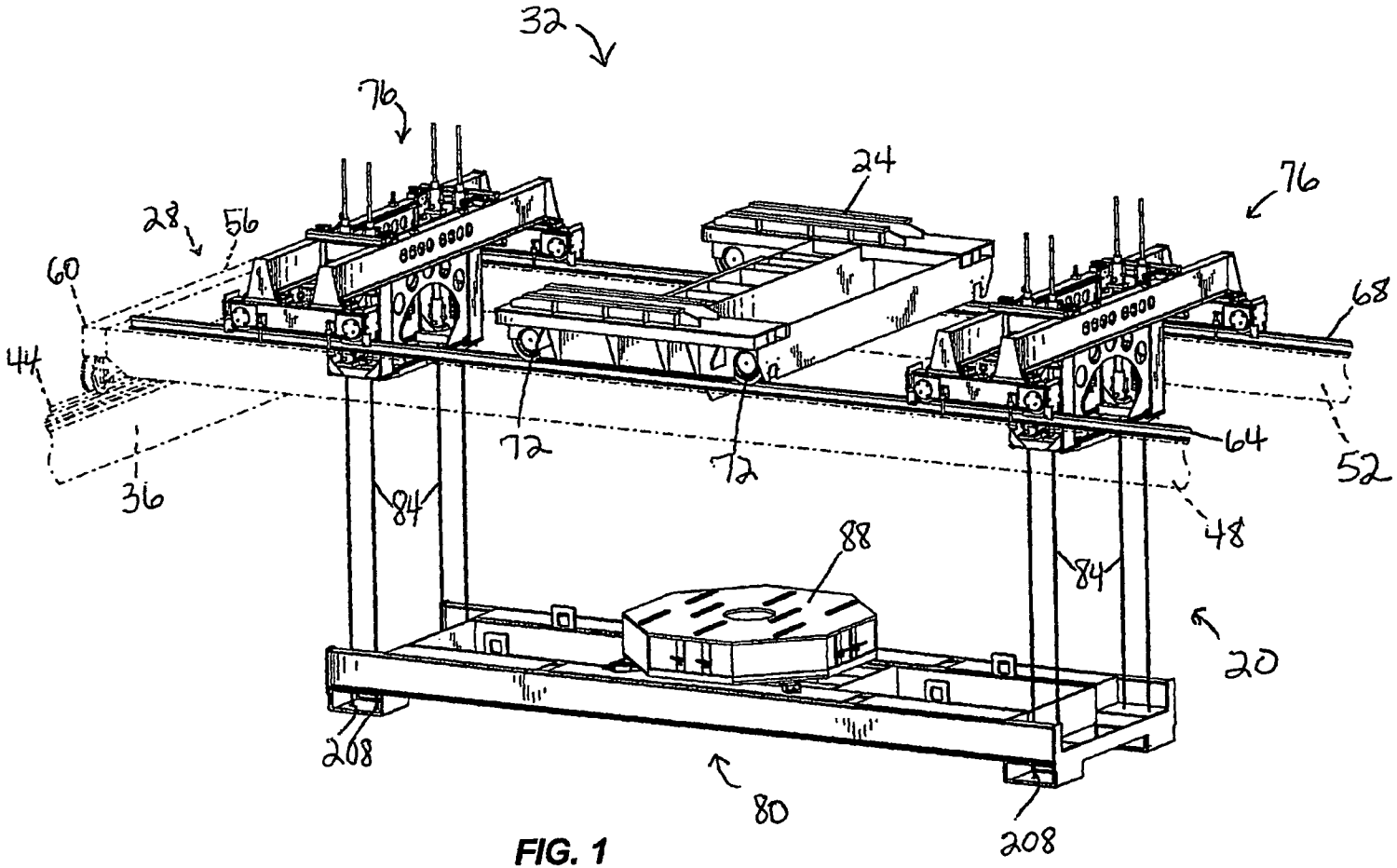
FIG. 1 illustrates a trolley installer according to one embodiment of the invention, the trolley installer mounted to a carriage.

FIG. 1 illustrates an embodiment of a trolley installer tool 20. The trolley installer tool 20 allows a trolley 24 to be removed from or installed on a bridge 28 of a crane 32 (e.g., an overhead crane), including situations where access by a mobile crane is not feasible or practical. The trolley installer tool 20 may also be used to install other bridge mounted tools from a floor of a facility onto the bridge 28. The overhead crane 32 includes the bridge 28, or carriage, that translates along a first main support beam 36 and a second main support beam (not shown). The main support beams 36 generally extend between two walls (not shown) of the facility and are spaced apart and generally parallel to each other. As will be readily known to those of skill in the art, the main support beams 36 may alternatively be curved to match the inside wall contours of a round building, or include a single, curved support beam.

In the illustrated embodiment, top surfaces of the main support beams 36 define rails 44 that the carriage 28 travels along. The carriage 28 includes a first girder 48, a second girder 52, and a pair of end trucks 56 (only one of which is shown) that extend between the first and second girders 48, 52. The end trucks 56 are aligned generally parallel to the main support beams 36 and include main wheels 60 to facilitate travel of the carriage 28 on the rails 44. The first and second girders 48, 52 are spaced apart from each other and are generally parallel. The girders 48, 52 are aligned transversely to the main support beams 36. The trolley 24, or second bridge, travels along girder rails 64, 68 that are positioned on top surfaces of the first and second girders 48, 52. Wheels 72 are disposed on the trolley 24 to facilitate travel of the trolley 24 along the girder rails 64, 68. As will be readily known to those of skill in the art, any number of wheels 60, 72 may be disposed on the end trucks 56 of the carriage 28 or on the trolley 24, and the wheels 60, 72 may be driven wheels or idle wheels.

The trolley installer 20 includes two upper assemblies 76, or lift systems, that travel along the girder rails 64, 68 and a lower assembly 80, or platform member, that is selectively coupled to the lift systems 76. The lift systems 76 are positioned on opposite sides of the trolley 24 and couple to opposite ends of the platform member 80 via strands 84. In one embodiment, the strands 84 may be eighteen mm wire cables, steel rope, or the like. The lift systems 76 are operable to raise the platform member 80 so that a table 88 contacts and engages the trolley 24. Further lifting of the platform member 80 raises the trolley 24 off the first and second girders 48, 52 and allows the table 88 to actuate (e.g., rotate, tilt, etc.) between a first position, or engaged position, and a second position, or transport position. In the engaged position, the trolley 24 spans between the girders 48, 52. Actuation of the table 88 to the transport position orients the trolley 24 such that, when the platform member 80 is lowered, the trolley 24 fits between the girders 48, 52 and lowers with the platform member 80 to the floor of the facility. Casters (not shown) positioned on the platform member 80 facilitate movement of the platform member 80, and associated loads, around a floor of the facility without the need for a crane. The trolley 24 is then removed from the table 88 and replaced with a new trolley, or a second platform member with a new trolley may be coupled to the lift systems 76. The new trolley is then raised by the lift systems 76 for installation on the overhead crane 32.

Figure 2:
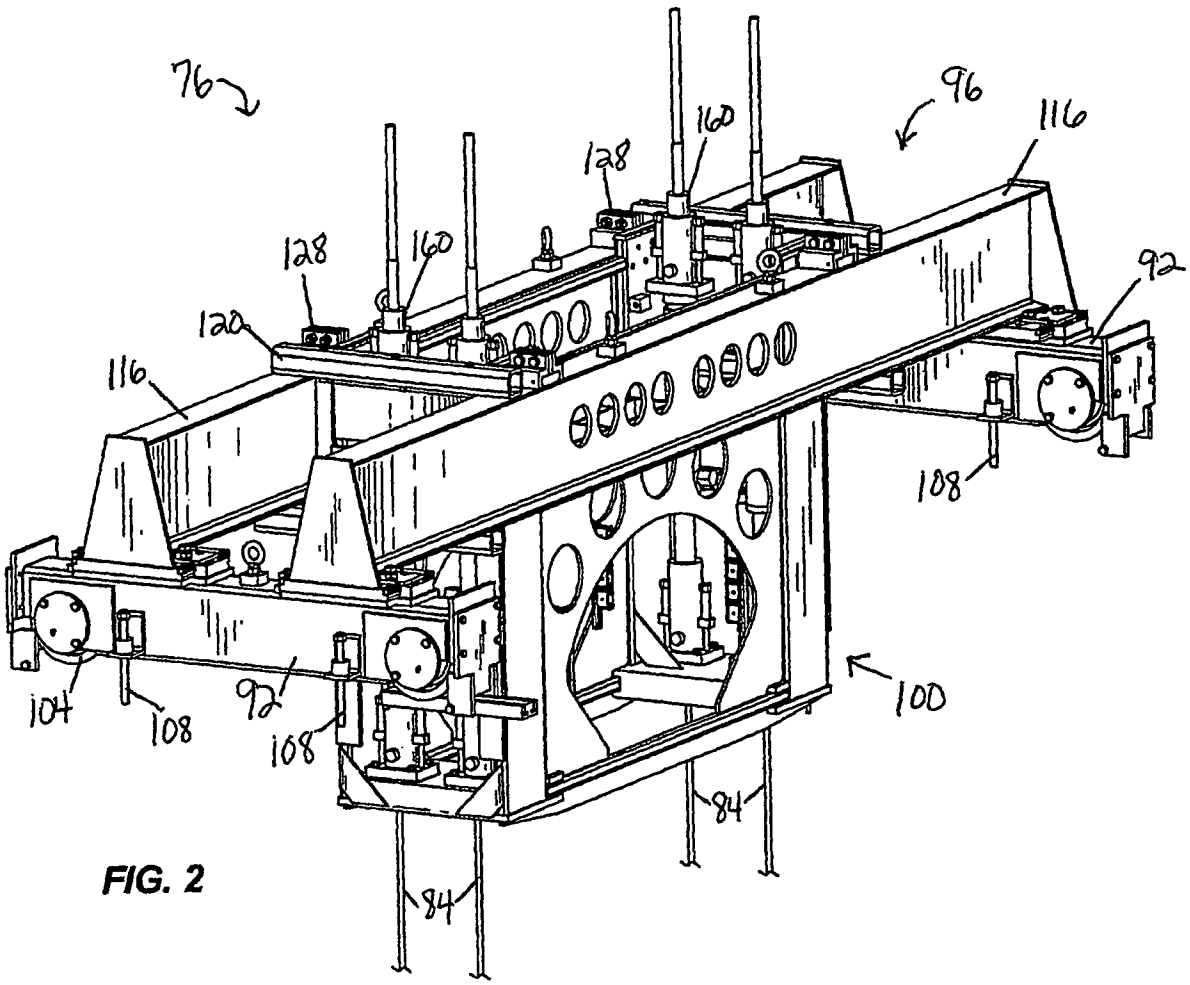
FIG. 2 is a perspective view of a lift system of the trolley installer shown in FIG. 1.
Figure 4:
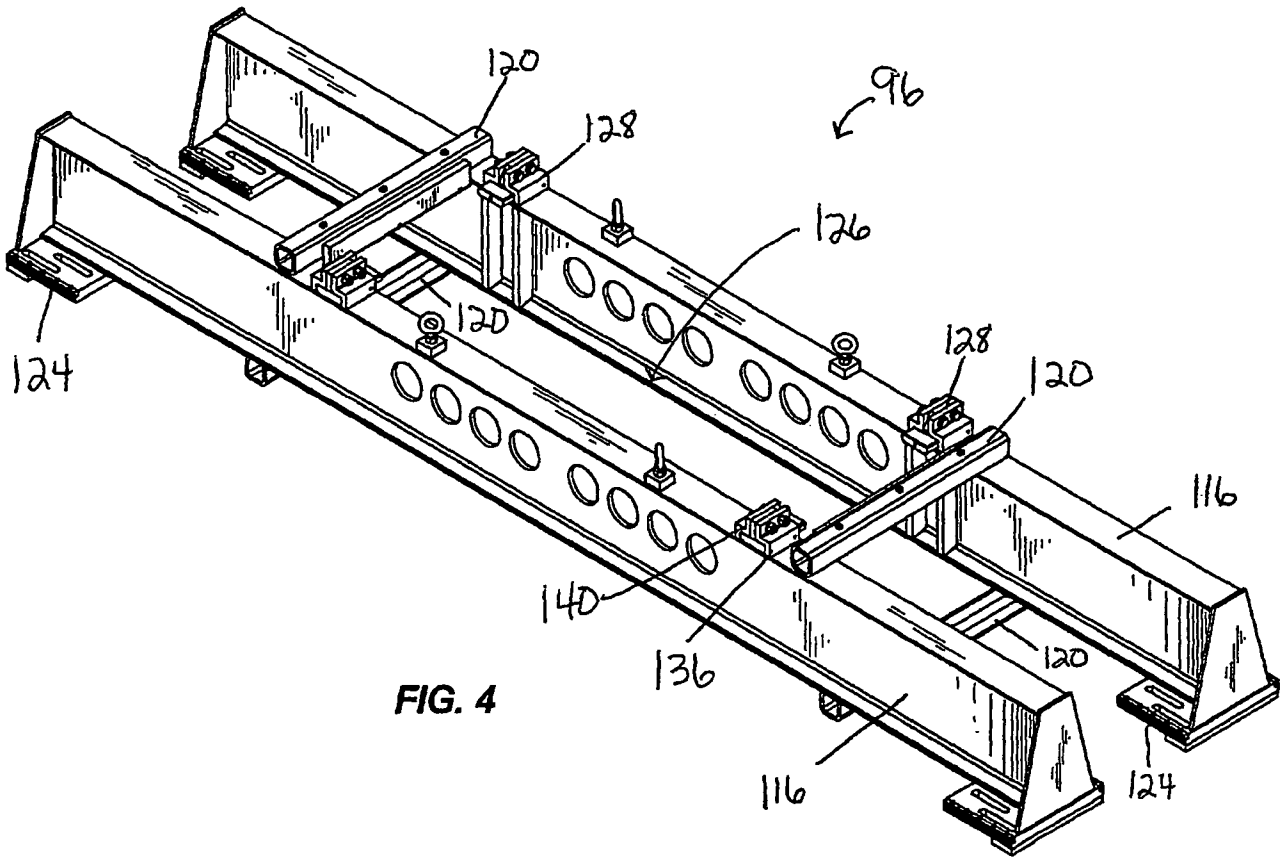
FIG. 4 is a perspective view of a cross member of the lift system shown in FIG. 2.
Figure 5A:
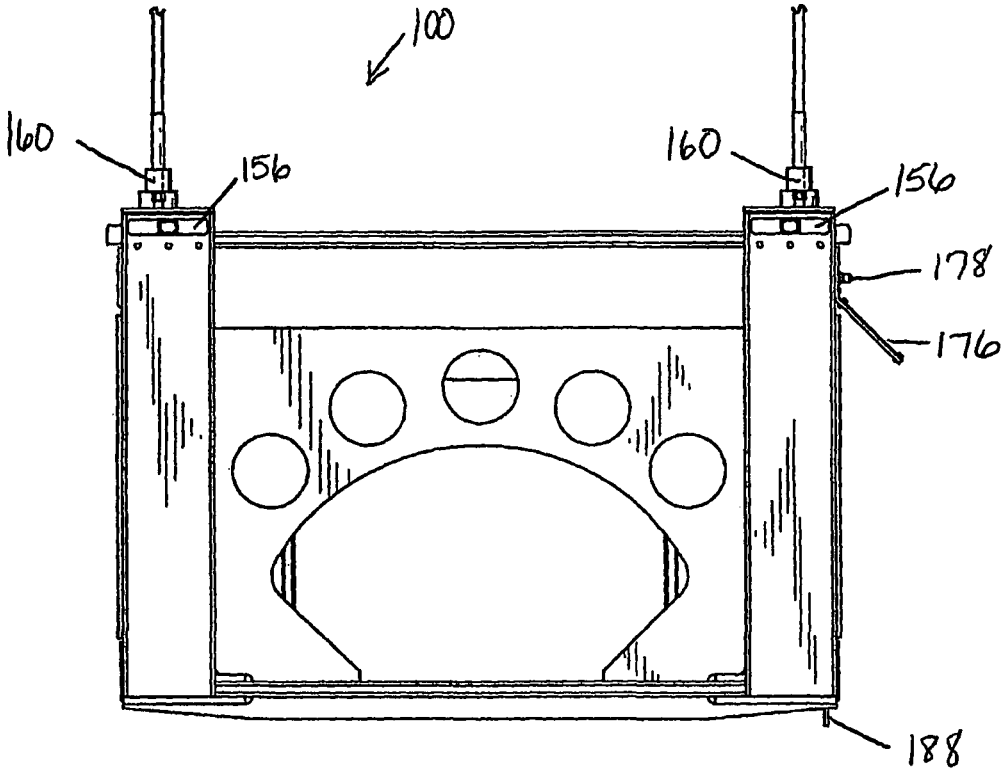
FIG. 5A is a side view of a jack assembly of the lift system shown in FIG. 2.

FIG. 2 illustrates the lift system 76 of the trolley installer 20. The lift system 76 includes a pair of end trucks 92 (FIG. 3) that travel along opposite girder rails 64, 68, a cross member 96 (FIG. 4) extending between the end trucks 92, and a lift mechanism 100 (FIG. 5A), or jack assembly, coupled to the cross member 96. The end trucks 92, the cross member 96, and the jack assembly 100 all include detachment means such that the components are separable from each other to facilitate delivery, assembly, and installation of the lift system 76.

Figure 3:
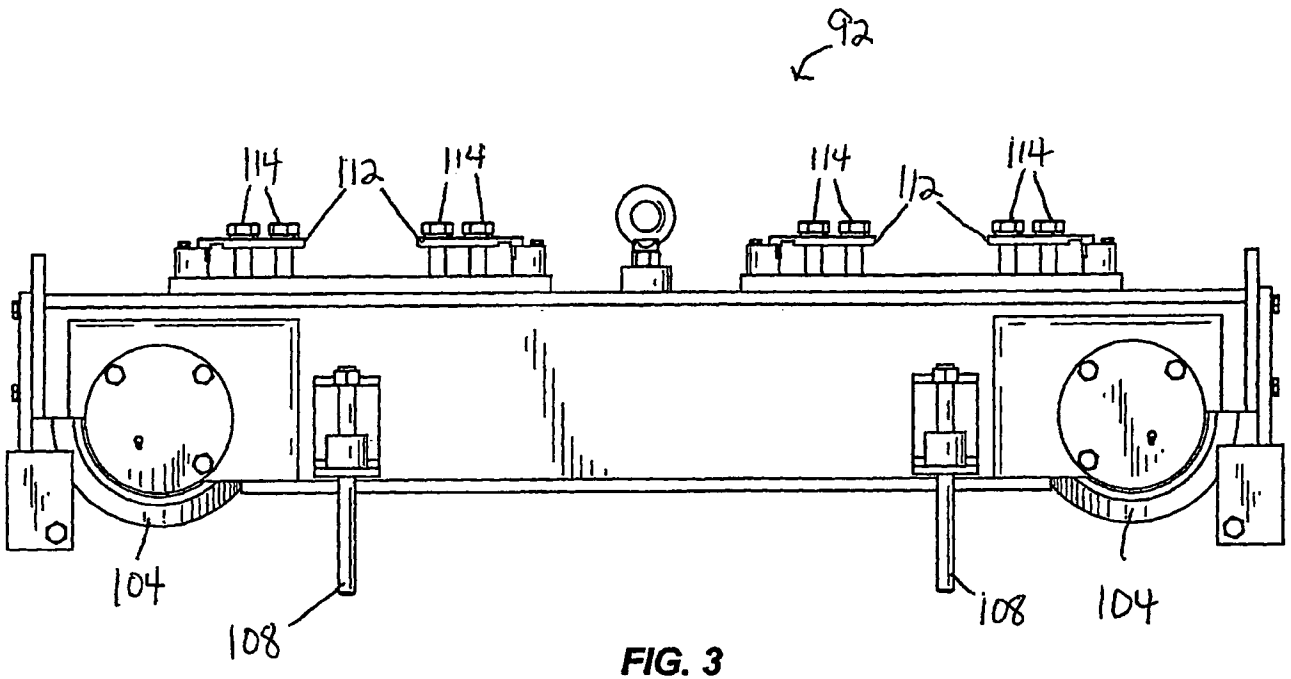
FIG. 3 is a side view of an end truck of the lift system shown in FIG. 2.

As shown in FIG. 3, each end truck 92 includes wheels 104, alignment rods 108, and attachment brackets 112 and bolts 114 to mount the cross member 96 to the end truck 92. In the illustrated embodiment, each end truck 92 includes two wheels 104 which may be driven wheels or idle wheels. It should be readily apparent to one skilled in the art that the end truck 92 may include fewer or more wheels 104 than the amount illustrated. Two alignment rods 108 extend downwardly at each end of the end truck 92, and are positioned to extend adjacent to each side of one of the girder rails 64, 68 and provide extra guidance during installation and operation of the lift system 76.

The cross member 96 (FIG. 4) includes a pair of cross beams 116, a plurality of joists 120, and mounting plates 124 to engage the brackets 112 of the end trucks 92. The joists 120 couple on top and bottom surfaces of the cross beams 116 to support and position the cross beams 116 parallel to each other. The cross beams 116 and the joists 120 define an area 126 where the jack assembly 100 is positioned. In one embodiment, the cross beams 116 telescope to adjust a distance between the end trucks 92 based upon a width of the bridge 28. Two jack mounts 128 (FIG. 6) are coupled to the top surface of each cross beam 116, for example, by welding, to support the lift system 76. In another embodiment, the jack mounts 128 are integrally formed with the cross beams 116 or are secured to the cross beams 116 with bolts.

Figure 6:
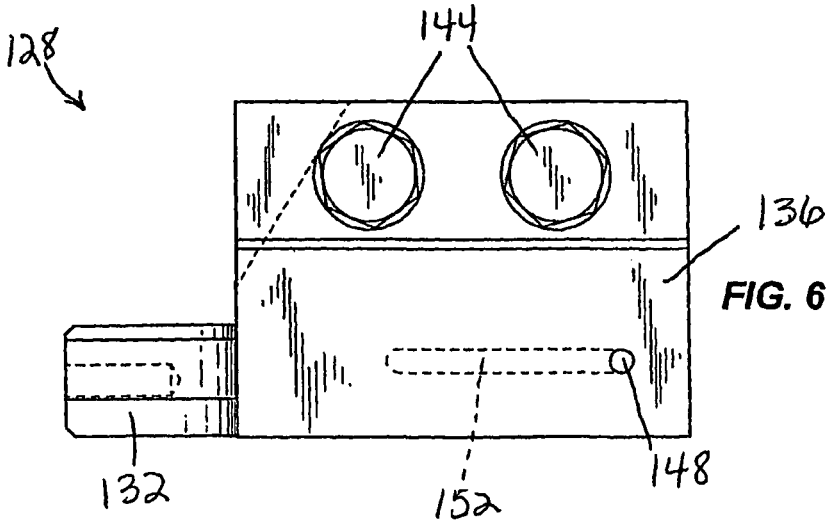
FIG. 6 is a side view of a jack mount.

Referring to FIG. 6, the jack mounts 128 each include a jack pin 132 slidable between an extended position (FIGS. 4 and 6) and a retracted position (not shown), and two brackets 136, 140 defining a chamber to receive the jack pin 132. Bolts 144 extend through an upper portion of the brackets 136, 140 to adjust the size of the chamber. When the bolts 144 are tightened, the brackets 136, 140 come together, decreasing the size of the chamber and securing the jack pin 132 in place. Loosening the bolts 144 separates the brackets 136, 140, increasing the size of the chamber so that the jack pin 132 is slidable within the chamber. A pin 148, or screw, on one bracket 136 extends into a slot 152 of the jack pin 132, preventing the jack pin 132 from sliding entirely out of the chamber.

The jack assembly 100 (FIG. 5A) is positioned between the end trucks 92 and the cross member 96, in the area 126 defined by the cross beams 116 and the joists 120. The jack mounts 128 are positioned on the cross member 96 to align with and engage windows 156 of the jack assembly 100. When extended, the jack pins 132 slide through the windows 156 to couple the jack assembly 100 to the cross member 96.

Figure 5B:
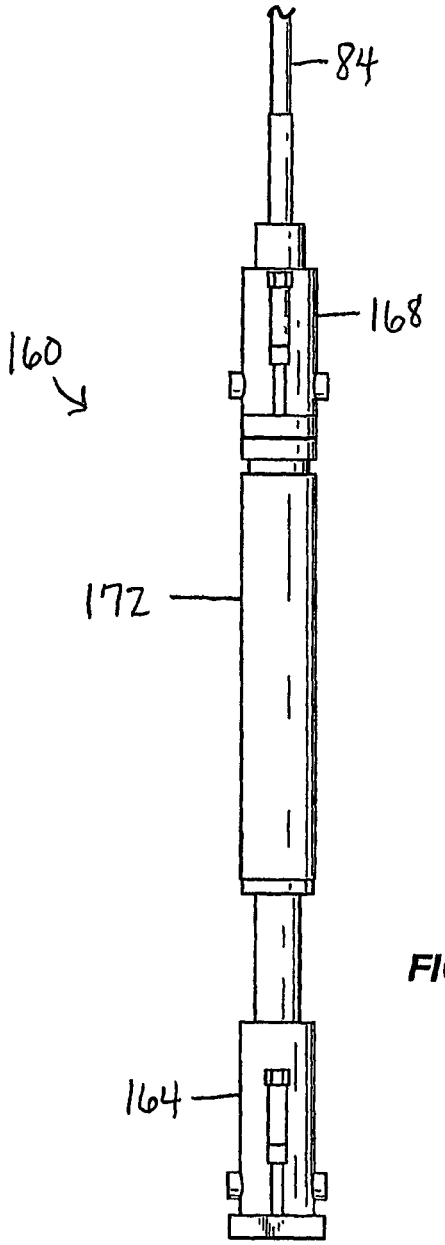
FIG. 5B is a side view of a strand jack.

The jack assembly 100 supports four strand jacks 160. However, it should be readily apparent to one skilled in the art that fewer or more strand jacks 160 may be used with the jack assembly 100. Each strand jack 160 (FIG. 5B) takes-up and releases one strand 84, or cable, to raise and lower the platform member 80. In another embodiment, a hoist system is supported by the jack assembly 100 to raise and lower the platform member 80. The strand jacks 160 may be, for example, strand jack systems manufactured by Bidlift Limited (North East Lincolnshire, UK), which are capable of lifting up to 600 tons per jack and operate at speeds up to 60 meters per hour.

Each strand jack 160 includes a bottom anchor 164, a top anchor 168, and a hydraulic piston 172. The bottom and top anchors 164, 168 are both selectively operable to clamp the cable 84. Actuation of the hydraulic piston 172 moves the cable 84 through the strand jack 160 and automatically transfers support between the bottom anchor 164 and the top anchor 168, thereby lifting the load by a ratchet or "inch-worm" type mechanism. The strand jacks 160 repeatedly perform this operation to take-up a sufficient length of cable 84. Releasing the cable 84 transfers support of the cable 84 from the top anchor 168 to the bottom anchor 164 and also includes the use of a secondary hydraulic system (not shown) built into the strand jack 160 to work in conjunction with the hydraulic piston 172. During operation of the trolley installer 20, eight strand jacks 160 (four per lift system 76) work in unison to raise and lower the platform member 80.

Figure 5C:
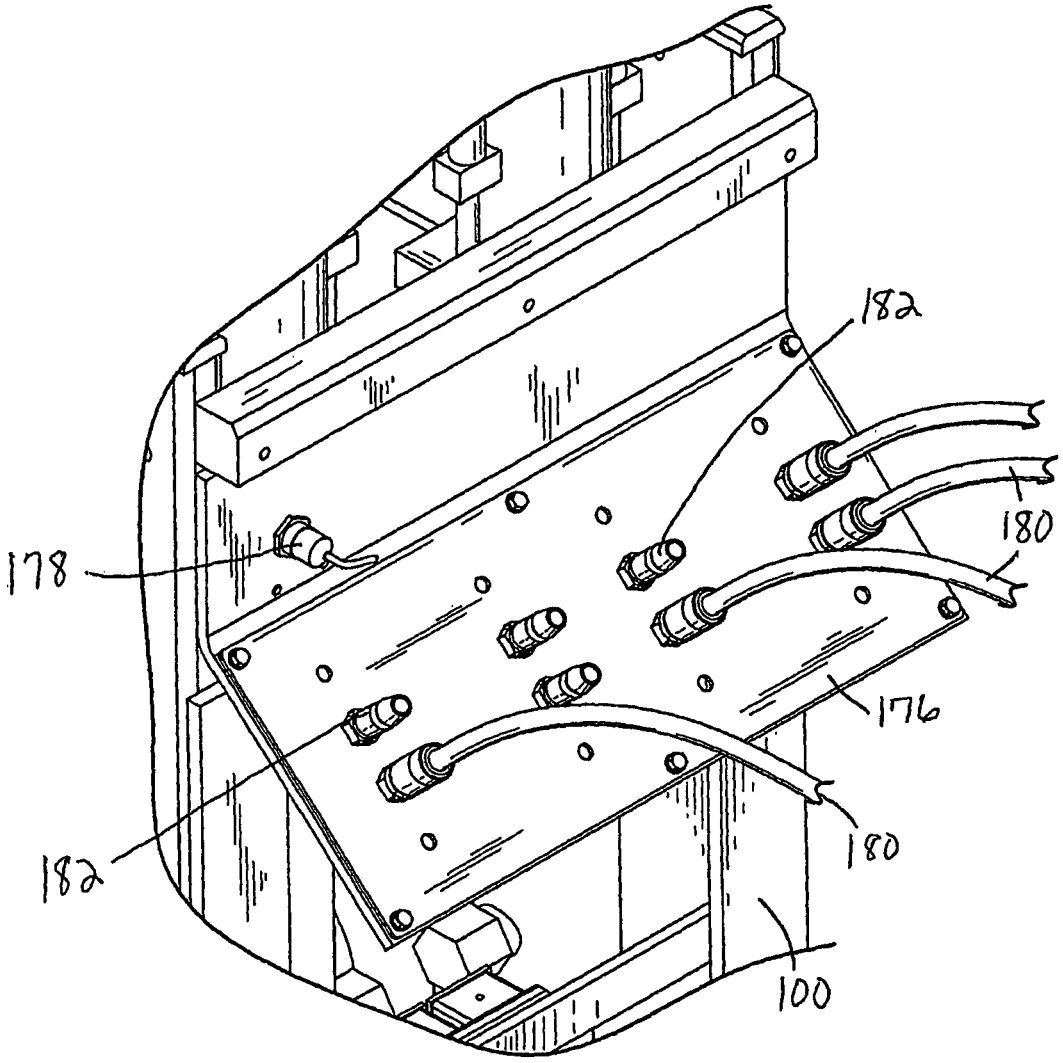
FIG. 5C is a perspective view of a bulkhead plate.

Each jack assembly 100 (FIG. 5A) also includes a bulkhead plate 176 and a proxy switch 178. The bulkhead plate 176 (FIG. 5C) serves as a culmination area for a plurality of hydraulic lines 180. The bulkhead plate 176 includes opposing quick-connect nipples 182 positioned on each side of the bulkhead plate 176 such that hydraulic lines 180 connect on opposite sides of the bulkhead plate 176 and communicate with each other. One set of hydraulic lines 180 connects to the nipples 182 on one side of the bulkhead plate 176 and extend to a control unit 184, which is discussed below with respect to FIG. 11. A second set of hydraulic lines (not shown) connects to corresponding nipples (not shown) on the other side of the bulkhead plate 176 and extend to the strand jacks 160, such that strand jacks 160 are brought into communication with the control unit 184.

The proxy switch 178, or over-travel switch, electrically connects with a rod 188 extending from the bottom of the jack assembly 100. The proxy switch 178 serves as a safety mechanism to prevent the platform member 80 from being lifted too high (i.e., to prevent the platform member 80 from contacting the jack assembly 100). If the platform member 80 is lifted too high, the top surface of the platform member 80 will engage the rod 188 and push upward. Moving the rod 188 upward causes the switch 178 to actuate, which in turn shuts down the trolley installer 20, including the strand jacks 160. The switch 178 is reset before operation of the trolley installer 20 resumes.

Figure 7A:
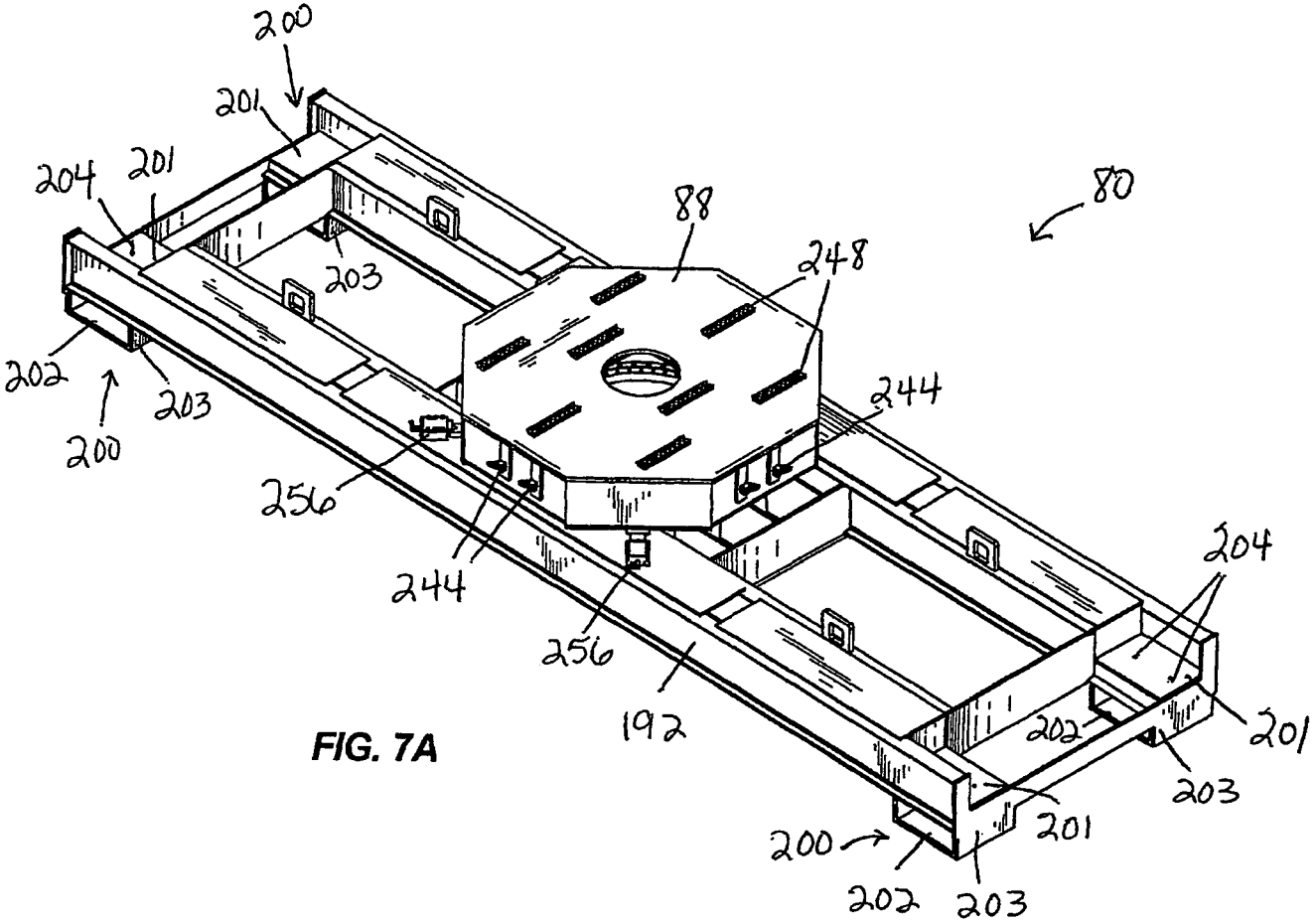
FIG. 7A is a perspective view of a turntable platform assembly according to one embodiment of the invention.
Figure 7B:
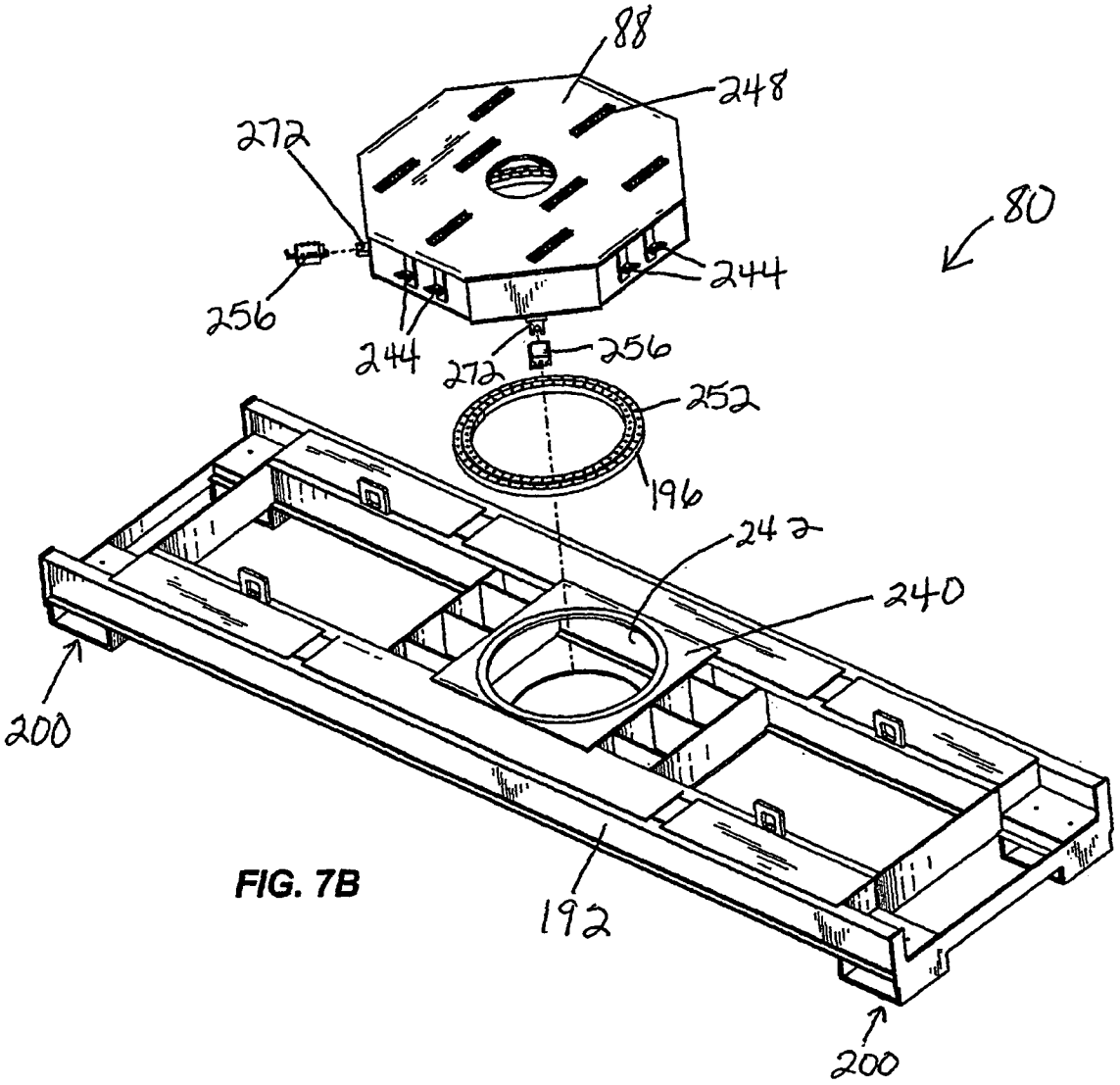
FIG. 7B is an exploded view of the turntable platform assembly shown in FIG. 7A.

FIGS. 7A and 7B illustrate the platform member 80. The platform member 80 includes the table 88, a frame 192, and a bearing 196. The frame 192 has a generally rectangular shape and includes four coupling areas 200, one at each corner, to facilitate connection of the cables 84 to the platform member 80. In the illustrated construction, each coupling area 200, or receptacle, is defined by a top plate 201, a bottom plate 202, and a pair of side walls 203. Each top plate 201 includes two apertures 204 and each bottom plate 202 includes two apertures 208 (FIG. 1) that align with the cables 84 extending downward from the lift system 76. Each cable 84 passes through a corresponding aperture 204 on the top plate 201 and a corresponding aperture 208 on the bottom plate 202. A pair of attachment mechanisms 212 (FIGS. 8A and 8B), or collets, are removably positioned inside each coupling area 200 adjacent to and between the apertures 204, 208, such that the cables 84 passing through the coupling area 200 also pass through one of the collets 212. The collets 212 selectively lock to the cables 84 and prevent relative movement between the cables 84 and the platform member 80. Operation of the lift system 76 to raise or lower the cables 84 will likewise cause the platform member 80 to raise and lower.

Figure 8B:
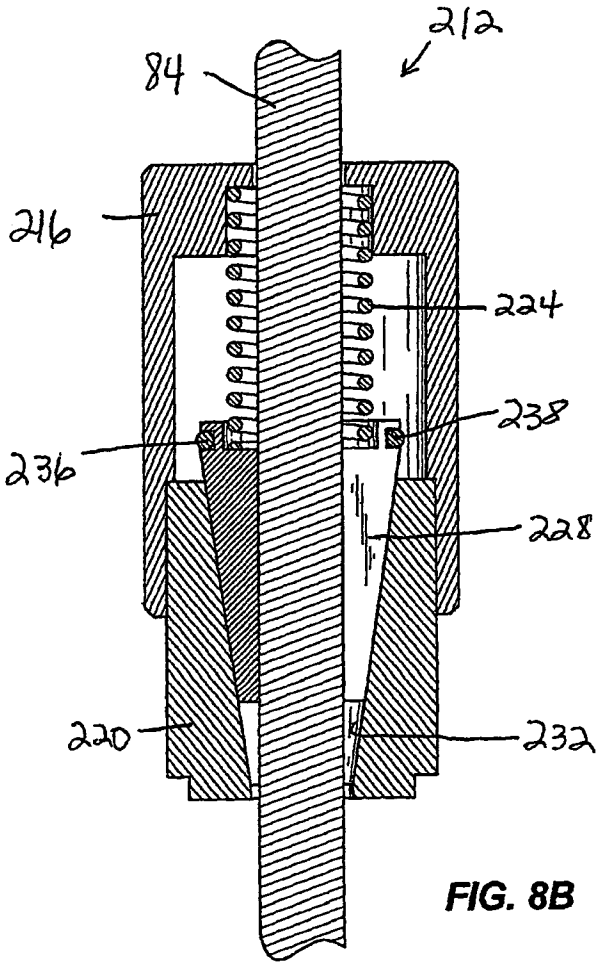
FIG. 8B is a cross-sectional view of the collet shown in FIG. 8A taken through section line 8B-8B.
Figure 8A:
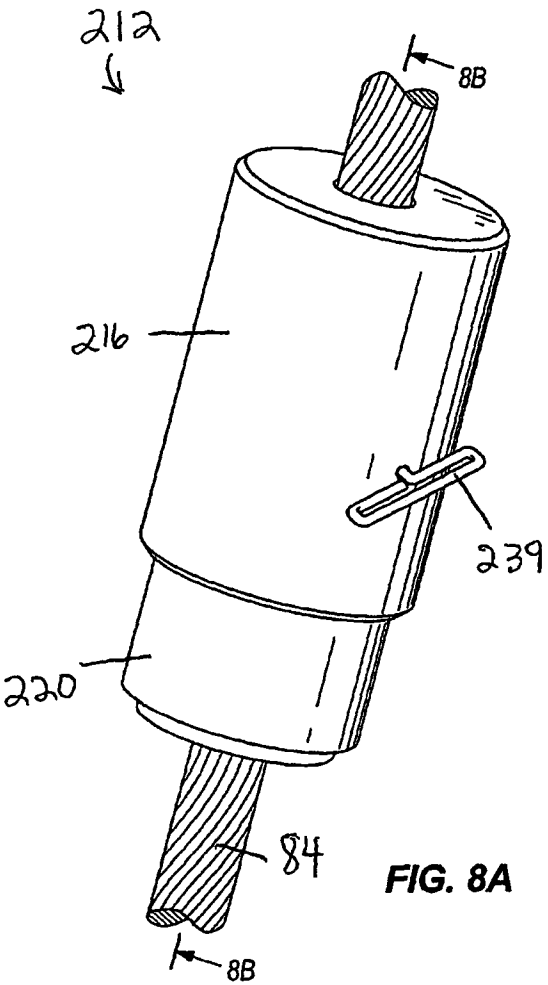
FIG. 8A is a perspective view of a collet.

Referring to FIGS. 8A and 8B, the collet 212 includes an upper body 216, a lower body 220, a spring 224, and a grip 228. The lower body 220 is partially received by the upper body 216 and includes a conical aperture 232. The grip 228 is positioned inside the upper body 216 and the lower body 220, and the grip 228 is biased by the spring 224 towards the conical aperture 232. The grip 228 is divided into three sections such that the grip 228 expands apart and compresses together. An annular element 236, or ring, seated in an annular groove 238 of the grip 228 engages the grip 228 to selectively compress the grip 228; that is, decreasing the diameter of the ring 236 (i.e., tightening) brings the sections of the grip 228 closer together. A pair of wings 239 formed on the ring 236 extends out of the upper body 216 to allow an operator to adjust the diameter of the ring 236. In the illustrated embodiment, rotation of the wings 239 in a clockwise direction decreases the diameter of the ring 236, and rotation of the wings 239 in a counter-clockwise direction increases the diameter of the ring 236.

The cable 84 passes through the upper body 216 and the lower body 220, and in the illustrated embodiment, the grip 228 and the spring 224. When the grip 228 is expanded, the sections are sufficiently spread apart (i.e., expanded) to allow the cable 84 to slide through the grip 228. When the ring 236 is tightened, the grip 228 is compressed around the cable 84 and is biased further into the conical aperture 232. Compressing and biasing the grip 228 locks the collet 212 to the cable 84 to hold the cable 84 in the coupling area 200. When the ring 236 is loosened (i.e., increased in diameter), the grip 228 expands and slides out of the aperture 232 against the bias of the spring 224, allowing the cable 84 to be completely removed from the collet 212 and the platform member 80.

Referring back to FIGS. 7A and 7B, the table 88 is coupled to the frame 192 proximate a table support area 240 that defines a central aperture 242. The table 88 includes a series of tie-downs 244 positioned on sides of the table 88 and a plurality of rollers 248 on an upper surface of the table 88. Cables, chains, straps, or other connections means (not shown) engage the trolley 24 and the tie-downs 244 to securely couple the trolley 24 to the table 88. In one embodiment, the operator manually attaches and removes the connection means both when the trolley 24 is on the floor and when the trolley 24 is on the bridge 28. In another embodiment, the trolley 24 is secured to the table 88 by pins (not shown), which are manually or electrically actuated. The rollers 248, for example, a Superail™ roller manufactured by Custom Automation (Northville, Mich.), are partially recessed in the top surface of the table 88. The rollers 248 allow translation of the trolley 24 along an axis extending between the lift systems 76.

Figure 12A:
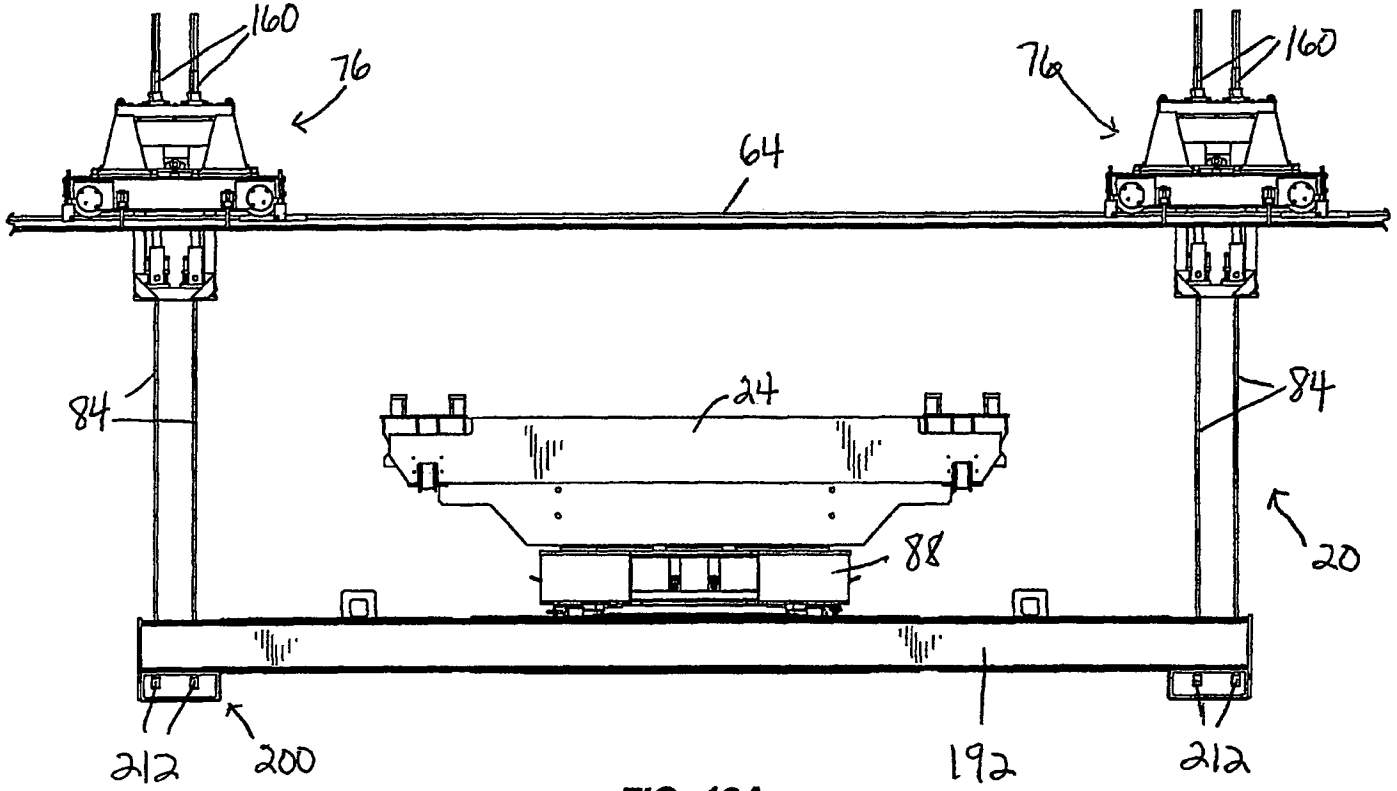
FIGS. 12A-12D illustrate a sequence of operation for the trolley installer embodying the invention.

In the construction shown, the table 88 is a turntable (i.e., the table rotates relative to the frame) that rotates the trolley 24 between the engaged position (FIG. 12C) and the transport position (FIG. 12A). The bearing 196, which is generally circular, is positioned about the central aperture 242 and defines a track 252 to receive a portion of the table 88. When received by the track 252, the table 88 is capable of rotating over 360 degrees with respect to the frame 192. Rotating the table 88, and therefore the trolley 24, in either direction about 90 degrees changes the trolley 24 from the engaged position to the transport position. Continuing rotation of the table 88 about 90 degrees more or rotating the table about 90 degrees in the opposite direction changes the trolley 24 back to the engaged position. The table 88 is rotated manually, by a motor, or by other known automated mechanisms. When the trolley 24 is coupled to the table 88, the trolley 24 rotates with the table 88.

Figure 9:
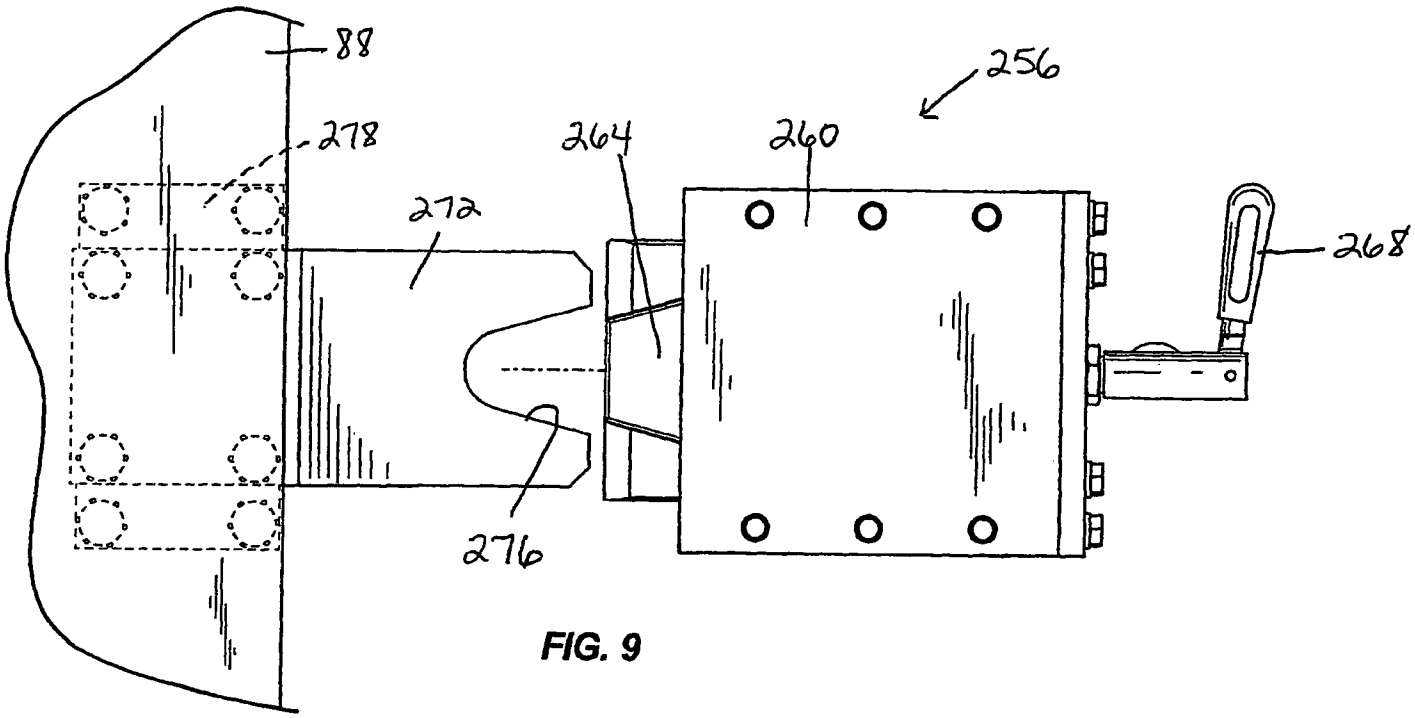
FIG. 9 is a top view of a lock assembly.

The platform member 80 includes lock assemblies 256 (e.g., two) coupled to the frame 192 and positioned proximate the aperture 242 to selectively prevent rotation of the table 88. It should be readily apparent to one skilled in the art that fewer or more lock assemblies 256 may be used and the lock assemblies 256 may be positioned at different locations with respect to the table 88. Referring to FIG. 9, each lock assembly 256 includes a body 260, a tongue 264, and a lever 268. The body 260 is coupled to the table support area 240 proximate the table 88 and spaced apart from the aperture 242. Actuation of the lever 268 extends the tongue 264 from the body 260 and towards the table 88. Receivers 272 are positioned on alternating sides of the table 88 and include a slot 276 and a hub 278. The hub 278 is coupled to a bottom surface of the table 88 such that the receiver 272 and the slot 276 extend away from the table. When extended, the tongue 264 engages the slot 276 of the receiver 272 to hold the table 88 relative to the frame 192. In the embodiment shown in FIGS. 7A and 7B, the receivers 272 are positioned such that the table 88 is held at about 90 degree intervals. However, it should be readily apparent to one skilled in the art that the table 88 may be held at other intervals.

Figure 10A:
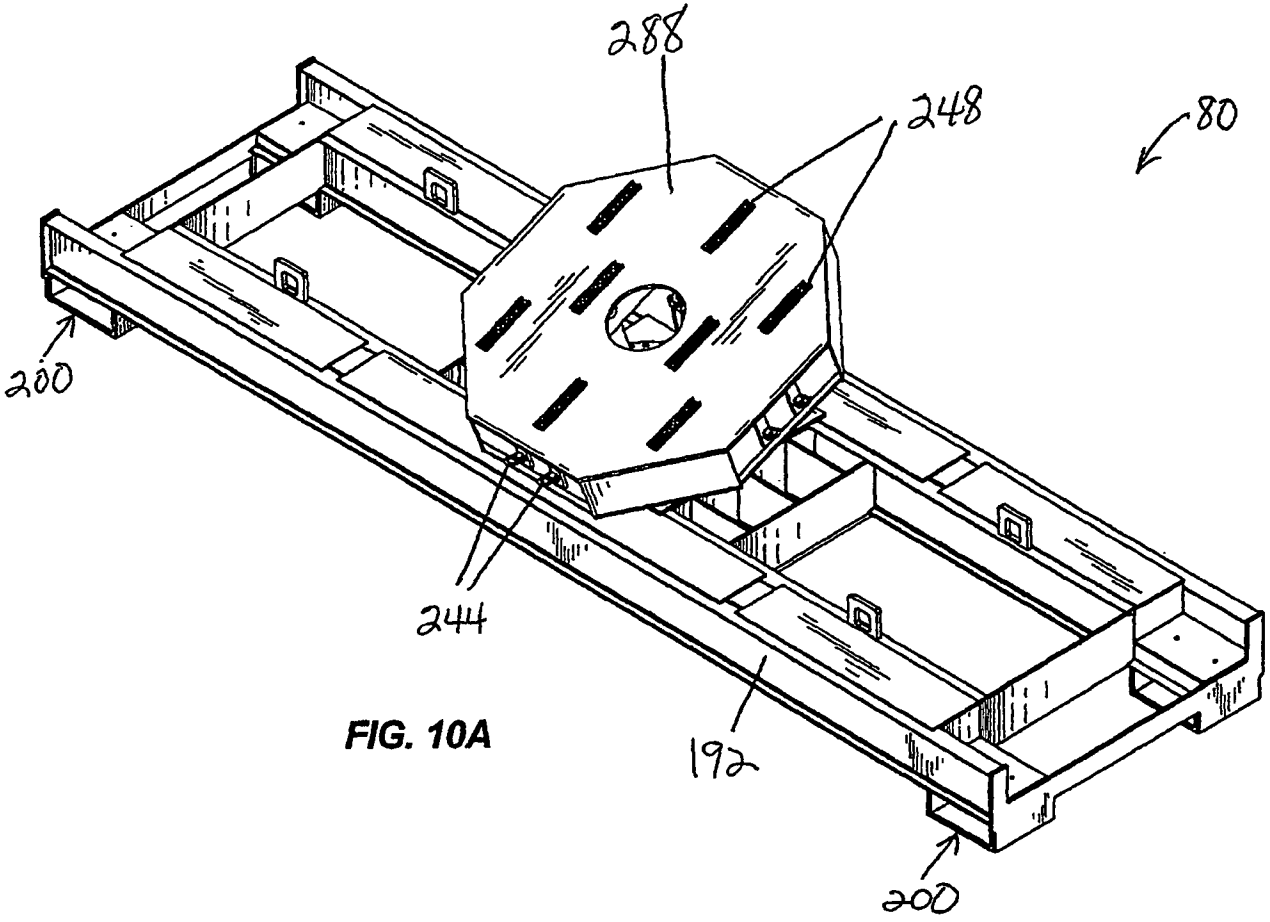
FIG. 10A is a perspective view of a tilt table platform assembly according to another embodiment of the invention.
Figure 10B:
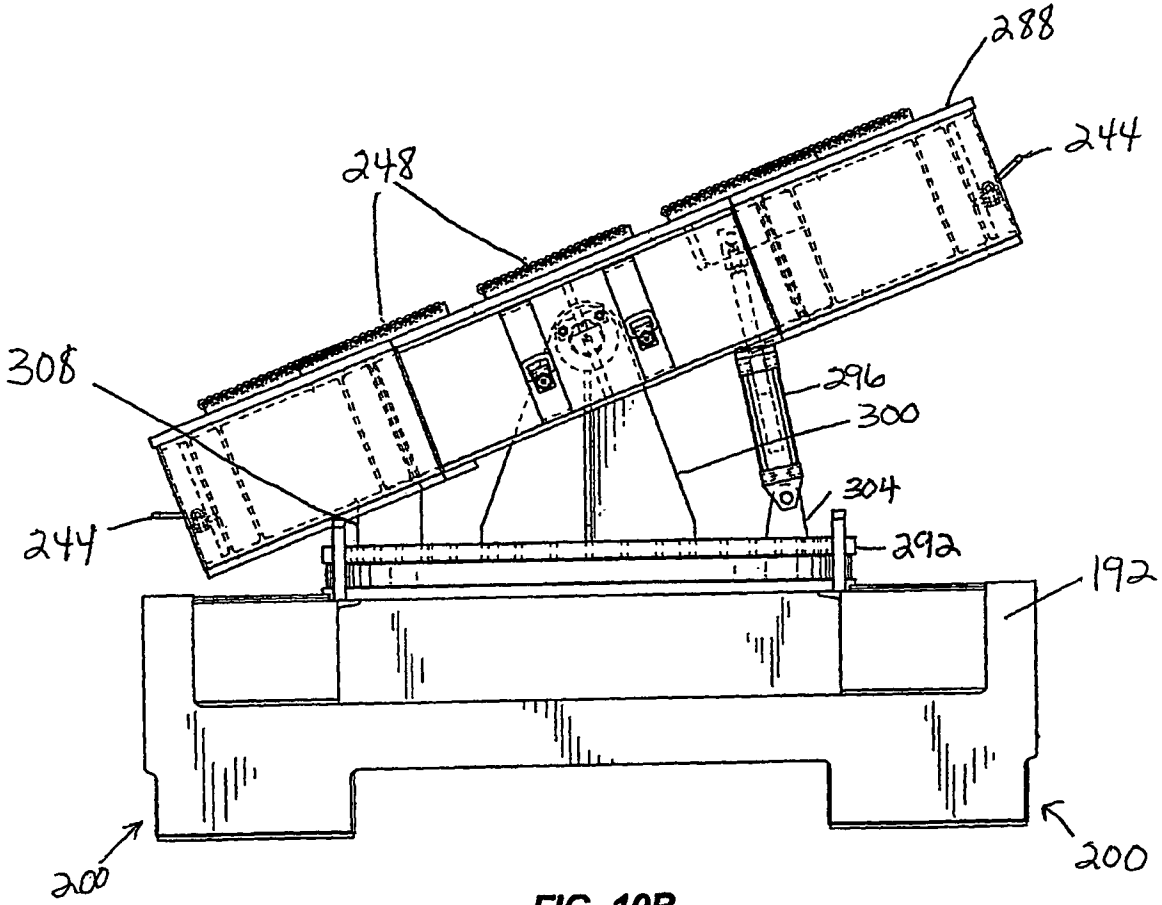
FIG. 10B is a side view of the tilt table platform assembly shown in FIG. 10A.
Figure 10C:
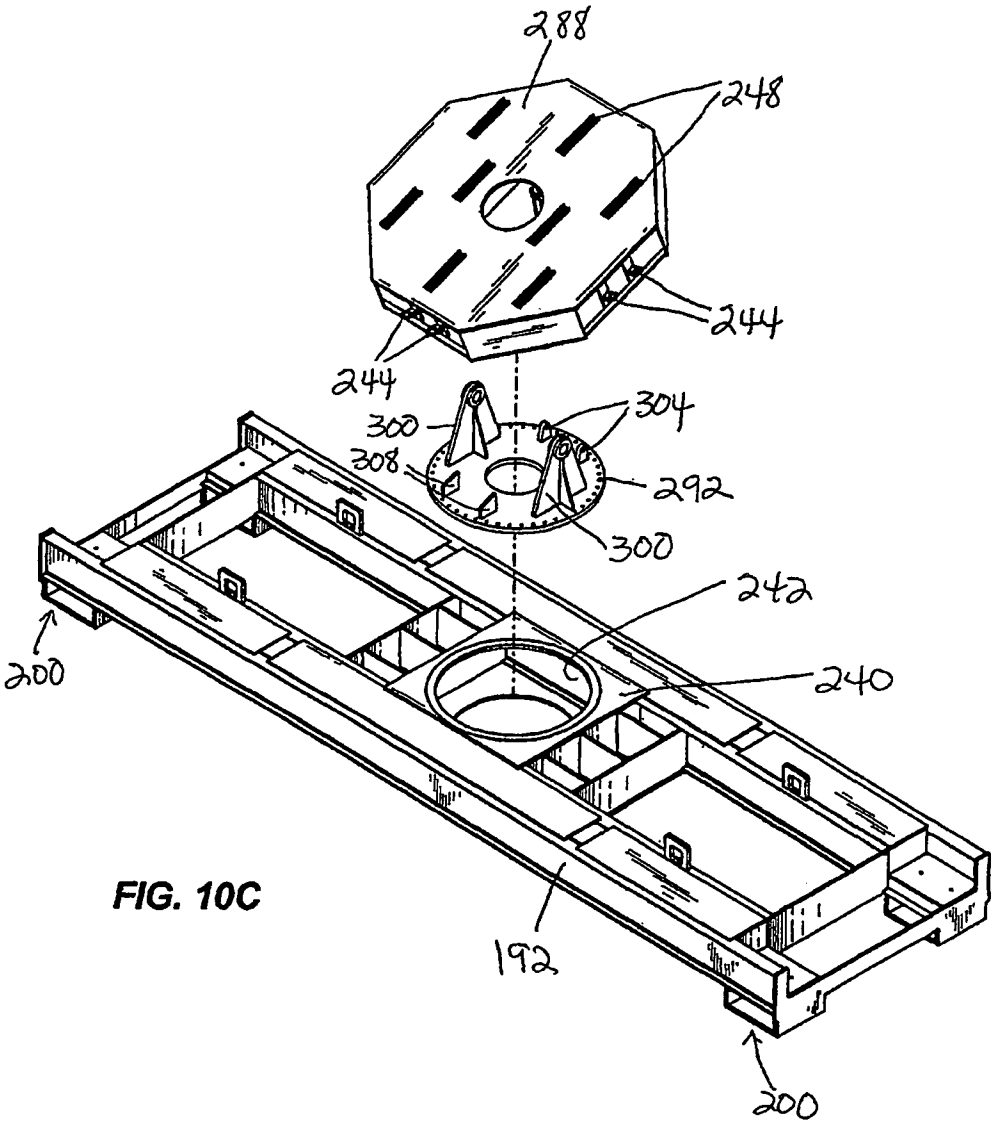
FIG. 10C is an exploded view of the tilt table platform assembly shown in FIG. 10A.

FIGS. 10A-10C illustrate another embodiment of a table 288 for the platform member 80. Except as described below, the table 288 and platform member 80 are substantially identical to the table 88 and platform member 80 discussed above, and common elements are identified by the same reference numerals. In the construction shown, the table 288 is a tilt table (i.e., the table tilts relative to the frame) which actuates the trolley 24 between the engaged position and the transport position. When the table 288, and therefore the trolley 24, is generally parallel relative to the frame 192 (FIG. 7A), the trolley 24 is in the engaged position. When the table 288, and therefore the trolley 24, is tilted relative to the frame 192 (FIG. 10A), the trolley is in the transport position.

The platform member 80 includes a tilting plate 292 (FIG. 10C) and a pair of hydraulic cylinders 296 (FIG. 10B). The plate 292 is coupled to the table support area 240 and is positioned over the central aperture 242. The plate 292 includes a pair of upwardly extending triangle shaped flanges 300, a pair of hydraulic brackets 304, and a pair of stops 308. The table 288 is pivotably coupled to the plate 292 at the flanges 300 such that the table 288 is spaced apart from the frame 192. Each hydraulic cylinder 296 extends between one hydraulic bracket 304 and the table 288. Actuation of the hydraulic cylinder 296 pivots the table 288 about the projections 300 (i.e., one portion of the table 88 is raised relative to the frame 192, and another portion is lowered relative to the frame 192), tilting the table 288 relative to the frame 192. The stops 308 are sized and shaped to support the table 288 at a predetermined angle relative to the plate. In the construction shown in FIGS. 10A-10C, the stops 208 support the table 288 at about 20 degrees. When the trolley 24 is coupled to the table 288, the trolley 24 tilts with the table 288.

Figure 11:
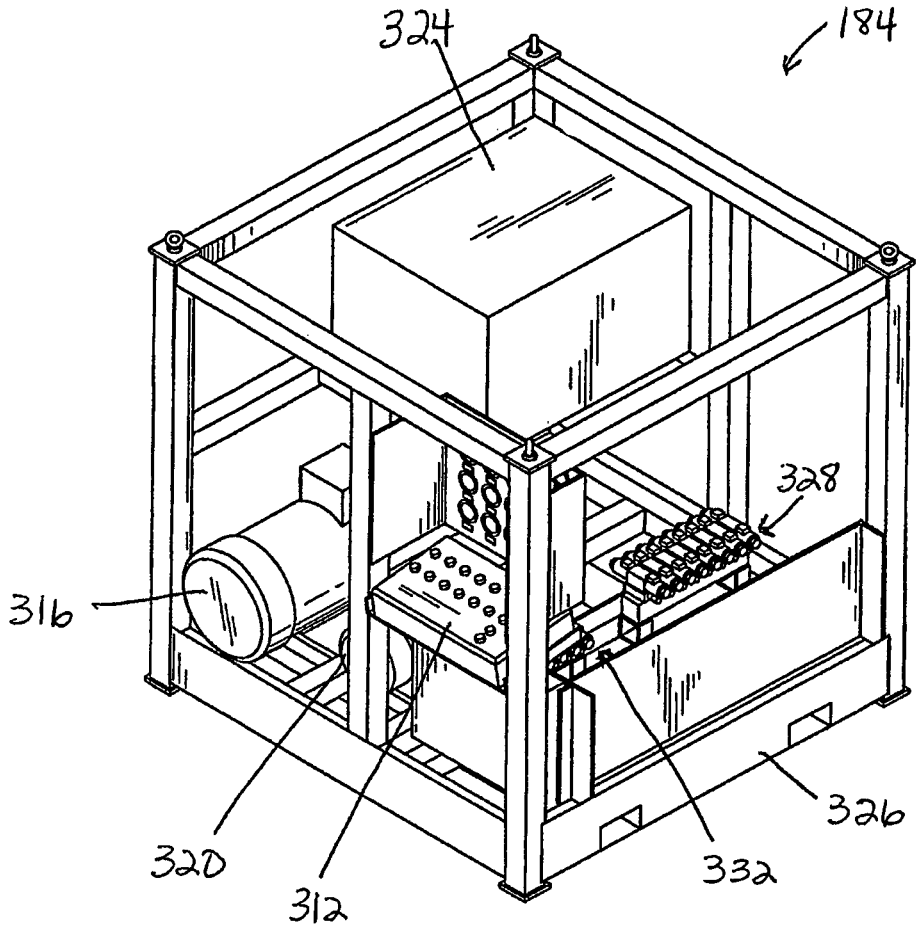
FIG. 11 is a perspective view of a hydraulic power pack.

FIG. 11 illustrates the control unit 184, or hydraulic power pack, used to control operation of the trolley installer 20, including operation of the strand jacks 160. The power pack 184 includes a control panel 312, a first motor 316, a second motor 320, a fluid reservoir 324, cylinder pumps 328, and clamp pumps 332. Separate hydraulic lines 180 run from the cylinder pumps 328 and clamp pumps 332 to the bulkhead plate 176 of the jack assembly 100 (FIG. 5C) to communicate with the strand jacks 160. Each strand jack 160 is coupled to one cylinder pump 238 and one clamp pump 332; therefore, if a hydraulic line ruptures or a valve fails, the remaining strand jacks 160 will support the platform member 80.

The control panel 312 allows the operator to monitor and control operation of the trolley installer 20. The control panel 312 includes separate power switches for each pump 328, 332, gauges to monitor the pressure and other parameters of the strand jacks 160, and a pair of joysticks to control raising and lowering of the platform member 80 and lateral movement of the lift assemblies 76. The power switches are provided such that the operator may operate each strand jack 160 individually to feed and load the cables 84 separately or to even the weight distribution if the pressure in one strand jack 160 becomes too great or too low. The first motor 316 (e.g., a 22 kW motor) drives the cylinder pumps 328, which communicate with the pistons 172 of the strand jacks 160. The cylinder pumps 328 actuate the pistons 172 of the strand jacks 160. The second motor 320 (e.g., a 3.7 kW motor) drives the clamp pumps 332, which communicate with the bottom and top anchors 164, 168 of the strand jacks 160. The clamp pumps 332 actuate the bottom and top anchors 164, 168 to clamp on the cables 84. The fluid reservoir 324 collects and stores excess fluid from the pumps 328, 332 and also provides a source of coolant for the motors 316, 320. A drip pan 336 is positioned under the power pack 184 to collect any leaking or spilt fluid.

FIGS. 12A-12D illustrate a sequence of operation for the trolley installer tool 20 to install the trolley 24 on the crane bridge 28. Referring to FIG. 12A, the trolley 24 is coupled to the table 88 and rotated to the transport position to fit between the first and second girders 48, 52 (FIG. 1). The lock assemblies 256 are extended to engage the receivers 272 and prevent further rotation of the table 88, and thereby the trolley 24, relative to the frame 192. In the embodiment where the table is the tilt table 288, the table 288 and the trolley 24 coupled thereto are tilted to the transport position to allow the trolley 24 to fit between the girders 48, 52.

Figure 12B:
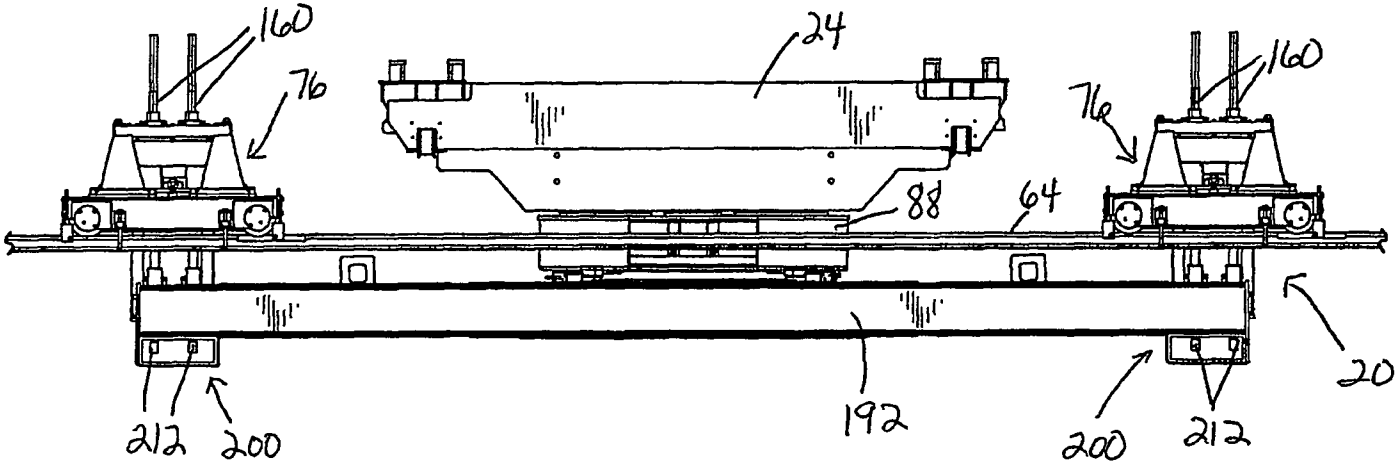
Figure 12C:
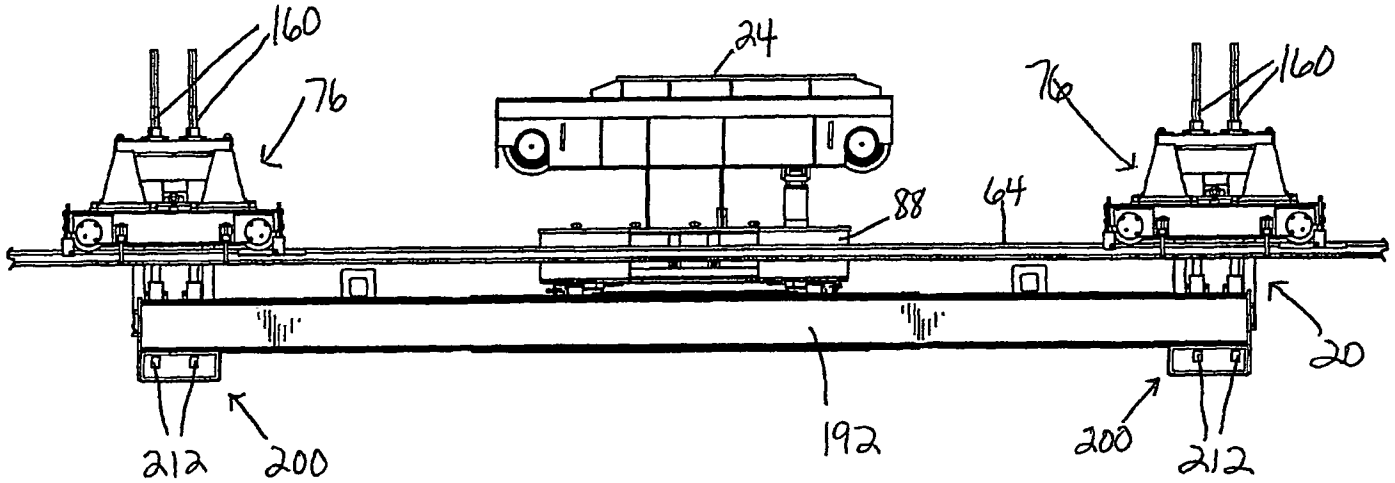
Figure 12D:
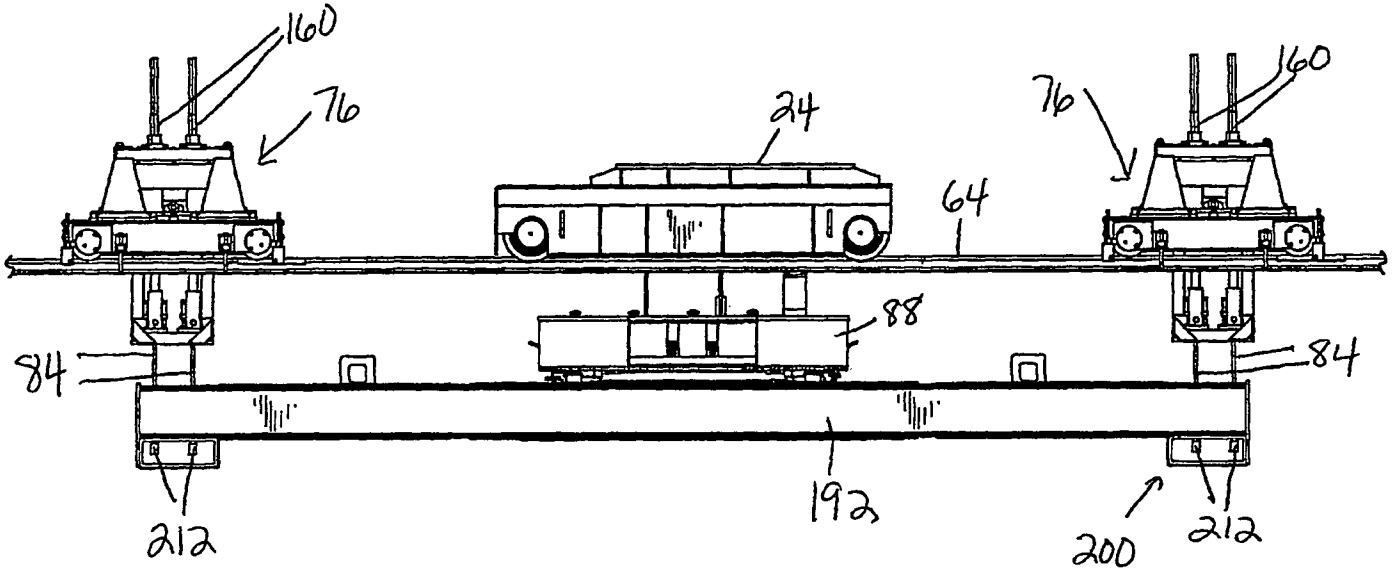

Next, the strand jacks 160 are actuated to raise the cables 84 in synchrony until the trolley 24 is lifted above the girder rails 64, 68 as shown in FIG. 12B. The lock assemblies 256 are disengaged from the receivers 272 such that the table 88, and thereby the trolley 24, are rotatable to the engaged position shown in FIG. 12C. At this orientation, the lock assemblies 256 are again extended to engage the receivers 272 and prevent further rotation of the table 88. In the embodiment where the table 88 is the tilt table, the table 288 and trolley 24 are pivoted back to the engaged position so the trolley 24 extends between the girder rails 64, 68 as shown in FIG. 12C. Next, the strand jacks 160 operate to lower the platform member 80 toward the floor of the facility. When the platform member 80 is lowered, the wheels 72 of the trolley 24 engage the girder rails 64, 68 as shown in FIG. 12D. The operator then uncouples the trolley 24 from the table 88, and the platform member 80 is lowered to the floor and disconnected from the cables 84.

To remove the trolley 24 from the overhead crane 32, the sequence of operation described above is performed in reverse. The platform member 80 is connected to the cables 84 and raised via the strand jacks 160 to engage the trolley 24. The trolley 24 is coupled to the table 88 so that the trolley 24 moves with the table 88. The platform member 80 lifts the trolley 24 out of contact with the girder rails 64, 68 and actuates the table 88, 288 to the transport position such that the trolley 24 fits between the girder rails 64, 68. The strand jacks 160 then operate to release the cables 84 and lower the platform member 80 and trolley 24 toward the floor.

Figure 13:
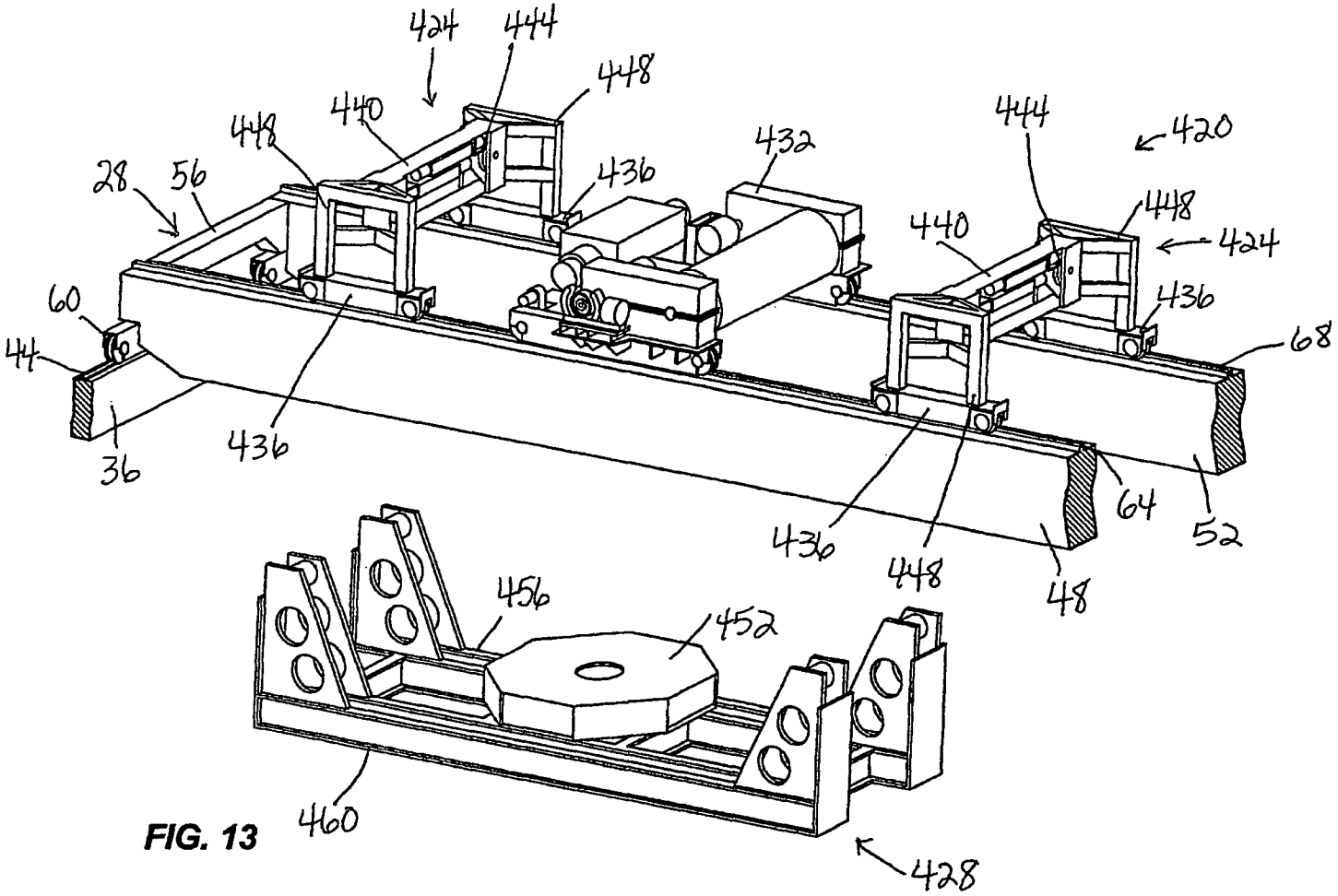
FIG. 13 is a perspective view of a trolley installer according to another embodiment of the invention, the trolley installer mounted to the carriage.

FIG. 13 illustrates another embodiment of a trolley installer tool 420. The trolley installer 420 includes two upper assemblies 424, or lift systems, that travel along the girder rails 64, 68 of the bridge 28 and a lower assembly 428, or lift deck, which is selectively coupled to the upper assemblies 424. The upper assemblies 424 are positioned on opposite sides of a trolley 432. Each upper assembly 424 includes a pair of end trucks 436 that travel along opposite girder rails 64, 68, a frame 440 extending between the two end trucks 436, and two lifting mechanisms 444 coupled to the frames 440 for raising and lowering the lift deck 428. The end trucks 436 include support members 448 for supporting the frame 440. In one embodiment, the frame 440 telescopes to adjust a distance between the end trucks 436 based upon a width of the bridge 28. The end trucks 436 allow the upper assemblies 424 to move along the girder rails 64, 68 for adjustment, thereby, the upper assemblies 424 are adjustable for various trolley spreads and sizes.

Each lifting mechanism 444 includes a wire rope jack (e.g., strand jack) or hoist system (not shown). The lifting mechanisms 444 include an attachment mechanism (not shown) at a free end of the rope or chain (not shown). Each of the attachment mechanisms is coupled to the lift deck 428 in one of the four corners to couple the lift deck 428 to the upper assemblies 424. Therefore, the lift mechanisms 444 are attachable to the lift deck 428 for lifting and lowering the lift deck 428. In one embodiment, the attachment mechanism includes a yoke and pin assembly that attaches to the lift deck 428. It should be readily apparent to those of skill in the art that fewer or more lifting mechanisms may be included with each upper assembly 424.

The lift deck 428 includes a rotatable table 452 supported by an upper surface 456 of the lift deck 428 and casters (not shown) supported by a lower surface 460 of the lift deck 428 for moving the lift deck 428, and associated loads, around on the floor without the need for a crane. The rotatable table 452, or center piece, of the lift deck 428 orients loads, or trolleys 432, during removal or installation. The table 452 is rotated manually, by an electric motor, or by other known means. In one embodiment, the table is a tilt table (now shown) that pivots relative to the upper surface 456 of the lift deck 428.

In operation, the lift deck 428 is raised by the lifting mechanisms 444 of the upper assemblies 424 and positioned underneath the existing trolley 432. The trolley 432 is then secured to the table 452 of the lift deck 428. For example, the trolley 432 may be secured to the table 452 by pins. In another embodiment, the lift deck 428 is secured to the upper assemblies 424 and the entire unit travels along the girder rails 64, 68 until the table 452 is positioned underneath the trolley 432. The existing trolley 432 is lifted off the girder rails 64, 68 by raising the lift deck 428, via the lifting mechanisms 444, in a generally upward direction. The table 452 rotates such that the trolley 432 is reoriented to fit between the girders 48, 52 and the lift deck 428 is lowered in a generally downward direction to lower the lift deck 428 and attached trolley 432 to the floor.

The lift deck 428 includes the casters such that the existing trolley 432 may be moved to another location and out of the way. A new trolley is secured to a second lift deck, and in particular, a rotatable table of the lift deck. The second lift deck is attached to the attachment mechanisms of the upper assemblies 424 and is lifted in a generally upward direction by the lifting mechanisms 444 into position such that the new trolley is positioned above the girder rails 64, 68. The table rotates such that the new trolley is reoriented and positioned for installation on the girder rails 64, 68. The second lift deck is then lowered such that the new trolley is positioned on the girder rails 64, 68. Once the new trolley is installed and detached from the table, the second lift deck is lowered to the floor and the upper assemblies 424 are removed from the bridge 28.

In order to perform removal and installation, the trolley installer tool was designed to eliminate the need for a mobile crane. The trolley installer provides for installation and removal of trolleys where a mobile crane cannot be used due to access issues or where the cost of a mobile crane can be forgone. The trolley installer is also safer than using a mobile crane due to line of site or lack of site issues.

Various features and advantages of the invention are set forth in the following claims.

What is claimed is:

1. A trolley installer for use with a crane bridge having a pair of spaced-apart girders configured for supporting a trolley spanning the spaced-apart girders and engaging a top of the spaced-apart girders, the trolley installer comprising:

a lift system adapted for mounting to the crane bridge, the lift system including a lift mechanism and a strand coupled to the lift mechanism; and a platform member including a frame with the strand releasably coupled thereto so that the lift mechanism lifts and lowers the platform member relative to the spaced-apart girders, and a table located at a top of the frame for supporting the trolley on top of the table and configured to actuate relative to the strand and the frame between an engaged position, where the table orients the trolley to span the spaced-apart girders so that the platform member and the trolley can be lowered together to engage the trolley with the spaced-apart girders and can be raised together to lift the trolley off of the spaced-apart girders, and a transfer position, where the table orients the trolley to fit between the spaced-apart girders so that the platform member and the trolley can be raised or lowered together between the spaced-apart girders.

2. The trolley installer of claim 1 wherein the lift system comprises a pair of the lift system spaced apart along the crane bridge, and further wherein the strand of one lift system of the pair of lift systems is releasably coupled to a first end of the platform member and the strand of the other lift system of the pair of lift systems is releasably coupled to a second end of the platform member.

3. The trolley installer of claim 1 wherein the lift system includes a plurality of the lift mechanism, and a plurality of the strand for releasably coupling to the platform member.

4. The trolley installer of claim 1 wherein the lift system includes a first end truck, a second end truck, and a cross member extending between the end trucks, the end trucks adapted for mounting to the crane bridge and the cross member adapted for supporting the lift mechanism.

5. The trolley installer of claim 1 wherein the lift mechanism is a strand jack.

6. The trolley installer of claim 1 wherein the lift mechanism is a hoist system.

7. The trolley installer of claim 1 wherein the lift mechanism includes a collet coupled to the strand, the collet releasably coupled to the platform assembly.

8. The trolley installer of claim 1 wherein the table of the platform member is a turntable for supporting the trolley, the table rotatable relative to the frame of the platform member between the engaged position and the transport position.

9. The trolley installer of claim 1 wherein the table of the platform member is a tilt table for supporting the trolley, the table pivotable relative to the frame of the platform member between the engaged position and the transport position.

10. A trolley installer for use with a crane bridge having a pair of spaced-apart girders configured for supporting a trolley spanning the spaced-apart girders and engaging a top of the spaced-apart girders, the trolley installer comprising:

a lift system adapted for mounting to the crane bridge, the lift system including a lift mechanism and a strand coupled to the lift mechanism; and a platform member including a frame with the strand releasably coupled thereto so that the lift mechanism lifts and lowers the platform member relative to the spaced-apart girders, and a turntable located at a top of the frame for supporting the trolley on top of the turntable and configured to rotate relative to the strand and the frame between an engaged position, where the turntable orients the trolley to span the spaced-apart girders so that the platform member and the trolley can be lowered together to engage the trolley with the spaced-apart girders and can be raised together to lift the trolley off of the spaced-apart girders, and a transfer position, where the turntable orients the trolley to fit between the spaced-apart girders so that the platform member and the trolley can be raised or lowered together between the spaced-apart girders.

11. The trolley installer of claim 10 wherein the platform member includes at least one lock assembly, the lock assembly operable to engage the turntable and hold the turntable relative to the platform member.

12. A trolley installer for use with a crane bridge having a pair of spaced-apart girders configured for supporting a trolley spanning the spaced-apart girders and engaging a top of the spaced-apart girders, the trolley installer comprising:

a lift system adapted for mounting to the crane bridge, the lift system including a lift mechanism and a strand coupled to the lift mechanism; and a platform member including a frame with the strand releasably coupled thereto so that the lift mechanism lifts and lowers the platform member relative to the spaced-apart girders, and a tilt table located at a top of the frame for supporting the trolley on top of the tilt table and configured to pivot relative to the strand and the frame between an engaged position, where the tilt table orients the trolley to span the spaced-apart girders so that the platform member and the trolley can be lowered together to engage the trolley with the spaced-apart girders and can be raised together to lift the trolley off of the spaced-apart girders, and a transfer position, where the tilt table orients the trolley to fit between the spaced-apart girders so that the platform member and the trolley can be raised or lowered together between the spaced-apart girders.

13. The trolley installer of claim 12 wherein the platform member includes a tilt plate, the tilt plate couples to the tilt table and defines a pivot point for the tilt table.

14. The trolley installer of claim 12 wherein the platform member includes at least one hydraulic cylinder, the at least one hydraulic cylinder operable to pivot the tilt table.

15. A trolley installer for use with a crane bridge having a pair of spaced-apart girders configured for supporting a trolley spanning the spaced-apart girders and engaging a top of the spaced-apart girders, the trolley installer comprising:

a pair of lift systems, each lift system including, a pair of end trucks adapted for mounting and traveling on the crane bridge, a cross member extending between the end trucks, and four lift mechanisms supported by the cross member, each lift mechanism including a strand;

a platform member including, a frame, a table located at a top of the frame for supporting and securing the trolley on top of the table, and configured to actuate relative to the strands of the lift systems and the frame between an engaged position, where the table orients the trolley to span the spaced-apart girders so that the platform member and the trolley can be lowered together to engage the trolley with the spaced-apart girders and can be raised together to lift the trolley off of the spaced-apart girders, and a transfer position, where the table orients the trolley to fit between the spaced-apart girders so that the platform member and the trolley can be raised or lowered together between the spaced-apart girders and coupling areas on the frame, each coupling area receiving at least one of the strands of the lift systems; and a control unit including a motor to drive the lift mechanisms;

wherein the lift mechanisms lift and lower the platform member relative to the spaced-apart girders of the crane bridge.

16. The trolley installer of claim 15 wherein at least one lift mechanism of the four lift mechanisms is a strand jack.

17. The trolley installer of claim 15 wherein at least one lift mechanism of the four lift mechanisms is a hoist system.

18. The trolley installer of claim 15 wherein the table of the platform member is a turntable for supporting the trolley, the table rotatable relative to a frame of the platform member between the engaged position and the transport position.

19. The trolley installer of claim 15 wherein the table of the platform member is a tilt table for supporting the trolley, the table pivotable relative to a frame of the platform member between the engaged position and the transport position.

20. The trolley installer of claim 15 wherein the strand of each of the lift mechanisms is coupled to the platform member by a collet that is received by the respective coupling area.

21. The trolley installer of claim 15 wherein the control unit includes power sources, the power sources adapted to drive the lift mechanisms.

22. A method for installing a trolley on a crane bridge with a trolley installer, the crane bridge having a pair of spaced-apart girders configured for supporting the trolley, the trolley installer comprising a lift system adapted for mounting to the crane bridge, the lift system including a lift mechanism and a strand coupled to the lift mechanism, and a platform member including a frame with the strand releasably coupled thereto so that the lift mechanism lifts and lowers the platform member relative to the spaced-apart girders, and a table located at a top of the frame for supporting the trolley on top of the table and configured to actuate relative to the strand and the frame between an engaged position, where the table orients the trolley to span the spaced-apart girders so that the platform member and the trolley can be lowered together to engage the trolley with the spaced-apart girders and can be raised together to lift the trolley off of the spaced-apart girders, and a transfer position, where the table orients the trolley to fit between the spaced-apart girders so that the platform member and the trolley can be raised or lowered together between the spaced-apart girders, wherein the lift mechanism lifts and lowers the platform member relative to the spaced-apart girders of the crane bridge, the method comprising the steps of:

coupling the trolley to the table of the platform member;

positioning the table in the transport position;

with the trolley coupled to the table with the table in the transport position and located below the space-apart girders, lifting the trolley between the spaced-apart girders of the crane bridge;

with the trolley located above the spaced-apart girders and coupled to the table with the table in the transport position, positioning the table to the engaged position;

with the trolley located above the spaced-apart girders and coupled to the table in the engaged position, lowering the platform member such that the trolley engages the spaced-apart girders of the crane bridge; and with the trolley engaging the spaced-apart girders, uncoupling the trolley from the platform member.

23. The method of claim 22 wherein the table is a turntable such that positioning the table to the transport position includes rotating the table, and positioning the table to the engaged position includes rotating the table.

24. The method of claim 22 wherein the table is a tilt table such that positioning the table to the transport position includes tilting the table, and positioning the table to the engaged position includes tilting the table.

25. The method of claim 22 wherein lifting the trolley between the spaced-apart girders of the crane bridge includes lifting the trolley above the spaced-apart girders the crane bridge.

26. A method for removing a trolley from a crane bridge with a trolley installer, the crane bridge having a pair of spaced-apart girders configured for supporting the trolley, the trolley installer comprising a lift system adapted for mounting to the crane bridge, the lift system including a lift mechanism and a strand coupled to the lift mechanism, and a platform member including a frame with the strand releasably coupled thereto so that the lift mechanism lifts and lowers the platform member relative to the spaced-apart girders, and a table located at a top of the frame for supporting the trolley on top of the table and configured to actuate relative to the strand and the frame between an engaged position, where the table orients the trolley to span the spaced-apart girders so that the platform member and the trolley can be lowered together to engage the trolley with the spaced-apart girders and can be raised together to lift the trolley off of the spaced-apart girders, and a transfer position, where the table orients the trolley to fit between the spaced-apart girders so that the platform member and the trolley can be raised or lowered together between the spaced-apart girders, wherein the lift mechanism lifts and lowers the platform member relative to the spaced-apart girders of the crane bridge, the method comprising the steps of:

with the trolley engaged with the spaced-apart girders of the crane bridge and the table of the platform member in the engaged position, raising the platform member to engage the trolley;

with the platform member engaging the trolley, coupling the trolley to the table of the platform member;

with the table of the platform member in the engaged position and the trolley coupled to the table of the platform member, lifting the trolley apart from the spaced-apart girders of the crane bridge;

with the trolley lifted apart from the spaced-apart girders of the crane bridge and the table of the platform member in the engaged position, positioning the table of the platform member in the transport position; and with the trolley lifted apart from the spaced-apart girders of the crane bridge and the table of the platform member in the transport position lowering the platform member and the trolley between the the spaced-apart girders of the crane bridge.

27. The method of claim 26 wherein the table of the platform member is a turntable such that positioning the table of the platform member in the transport position includes rotating the table of the platform member.

28. The method of claim 26 wherein the table of the platform member is a tilt table such that positioning the table of the platform member in the transport position includes tilting the table of the platform member.

* * * * *